US007591566B2

(12) United States Patent
Galke et al.

(10) Patent No.: US 7,591,566 B2
(45) Date of Patent: Sep. 22, 2009

(54) LIGHTING SYSTEM

(75) Inventors: Detlef Andreas Galke, North Salt Lake, UT (US); Melvin Hess Pedersen, North Salt Lake, UT (US)

(73) Assignee: Innovative D-Lites LLC, North Salt Lake, UT (US)

( * ) Notice: Subject to any disclaimer, the term of this patent is extended or adjusted under 35 U.S.C. 154(b) by 0 days.

(21) Appl. No.: 11/854,323

(22) Filed: Sep. 12, 2007

(65) Prior Publication Data

US 2008/0068838 A1 Mar. 20, 2008

Related U.S. Application Data

(60) Provisional application No. 60/844,986, filed on Sep. 15, 2006.

(51) Int. Cl.
*F21V 19/02* (2006.01)

(52) U.S. Cl. ..... 362/285; 362/271; 362/272; 362/286; 362/289

(58) Field of Classification Search ..... None
See application file for complete search history.

(56) References Cited

U.S. PATENT DOCUMENTS 3,287,552 A * 11/1966 Drandell ..... 362/233
3,569,691 A 3/1971 Tracy
3,692,993 A 9/1972 Robinson
3,702,928 A * 11/1972 Alger ..... 362/33
4,180,850 A * 12/1979 Bivens ..... 362/285
4,204,274 A * 5/1980 Luderitz ..... 362/239
4,967,324 A * 10/1990 Barclay ..... 362/147
5,025,349 A * 6/1991 Gow ..... 362/20
5,311,414 A 5/1994 Branham, Sr.
5,404,279 A 4/1995 Wood
5,510,966 A 4/1996 Konecny
5,564,815 A * 10/1996 Littman et al. ..... 362/147
5,594,628 A 1/1997 Reuter et al.
5,609,408 A * 3/1997 Targetti ..... 362/523
5,816,687 A 10/1998 Tapp
6,056,419 A 5/2000 March
6,088,967 A 7/2000 Johnson
6,224,232 B1 5/2001 Rodriguez
6,309,086 B1 10/2001 Tomlinson
6,424,096 B1 7/2002 Lowe et al.
6,517,216 B1 * 2/2003 Cercone et al. ..... 362/220
6,652,121 B1 11/2003 Kneeshaw
6,846,092 B2 1/2005 Taylor et al.
6,918,680 B2 7/2005 Seeberger

* cited by examiner

*Primary Examiner*—Sandra L O'Shea
*Assistant Examiner*—Danielle Allen
(74) *Attorney, Agent, or Firm*—Thorpe North & Western LLP

(57) ABSTRACT

A lighting system comprises a housing, suitable for mounting to a structural unit, the housing including a plurality of enclosure panels. At least one light-bearing member is moveable relative to each of the enclosure panels. An actuator is in operable communication with the at least one light-bearing member, the actuator being operable to selectively: extend the light-bearing member from the housing into a display configuration; and retract the light-bearing member into the housing. At least one lighting element is carried by the light-bearing member, the at least one lighting element being visible by a spectator when the light-bearing member is at least partially extended from the housing.

23 Claims, 8 Drawing Sheets

LIGHTING SYSTEM

RELATED APPLICATIONS

Priority is claimed of U.S. Provisional Patent Application No. 60/844,986, filed Sep. 15, 2006, which is hereby incorporated herein by reference in its entirety.

BACKGROUND OF THE INVENTION

1. Field of the Invention

The present invention relates generally to informational, decorative or auxiliary lighting systems. More particularly, the present invention relates to lighting systems that can at least partially be concealed or protected within a housing when not in use.

2. Related Art

Decorative and informational lighting displays have been provided in a variety of configurations for many years. One popular type of such displays is the perennial Christmas light display presented by many homeowners in connection with the Christmas holidays (such displays have also become popular with Halloween, Independence Day and a variety of other holidays). Such lighting displays typically include a plurality of "strings" of lights, often connected end-to-end, that are attached to a house near edges of the roof of the house, along raingutters of the house, beneath eaves of the house, etc.

As these lighting displays are rarely a permanent portion of the house, they are often installed a few days or weeks prior to a holiday, and removed after the holiday has passed. Due to the typical location of such displays, installing and removing the light strings often involves the use of ladders, or climbing on or across rooftops, or similar procedures that often place the installer at considerable risk of injury. In the case where the holiday occurs in a season that typically involves cold weather, this risk can be greatly increased due to the presence of ice or snow on the rooftop or on the ground. Also, most such lighting systems are not designed for permanent installation and so must be installed and removed each season. Even in the case where the lighting strings are designed to withstand year-round installation, many homeowners do not wish to leave the strings in place year-round, due to cosmetic reasons.

In addition to these considerations, strings of lights are notoriously difficult to store (and retrieve from storage) without causing the strings to be become frustratingly entangled. Also, extension cords are very often necessary to power the strings of light, adding complexity and fire/electrocution risk to the installation and removal process. Furthermore, the choice of decorative displays that can be presented with such lights is limited by the strands to very plain, one-dimensional displays.

SUMMARY OF THE INVENTION

The invention provides a lighting system, including a housing, suitable for mounting to a structural unit, the housing including a plurality of enclosure panels. At least one light-bearing member can be moveable relative to each of the enclosure panels. An actuator can be in operable communication with the at least one light-bearing member. The actuator can be operable to selectively: extend the light-bearing member from the housing into a display configuration; and retract the light-bearing member into the housing. At least one lighting element can be carried by the light-bearing member. The at least one lighting element can be visible by a spectator when the light-bearing member is at least partially extended from the housing.

In accordance with another aspect of the invention, a lighting system is provided, including a housing, suitable for mounting to a structural unit, the housing including a longitudinal dimension, a height dimension and a depth dimension. At least one light-bearing member can be moveable relative to the housing and can be extendable into a display configuration. The light-bearing member can carry thereon at least one lighting element. An actuator can be in operable communication with the at least one light-bearing member, the actuator being operable to selectively retract the light-bearing member into the housing after the light-bearing member has been extended from the housing into a display configuration. The light-bearing member can be sized such that: when the light-bearing member is in the display configuration the at least one lighting element is displaced from the housing a distance greater than a largest of: the depth dimension of the housing and the height dimension of the housing.

In accordance with another aspect of the invention, a lighting system is provided, including a housing, suitable for mounting to a structural unit. A plurality of light-bearing members can be moveable relative to the housing. The light-bearing members can be operably coupled to at least one actuator. The actuator can be operable to selectively retract the light-bearing members into the housing after the light-bearing members have been extended from the housing into a display configuration. A plurality of lighting elements can be provided, at least one of which is carried by each of the light-bearing members. The plurality of lighting elements can collectively define a changeable lighting element pattern. The system can be capable of providing at least two different lighting element patterns: a first lighting element pattern when the light-bearing members are retracted into the housing; and a second lighting element pattern when the light-bearing members are extended from the housing.

There has thus been outlined, rather broadly, relatively important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

DETAILED DESCRIPTION

Figure 2:
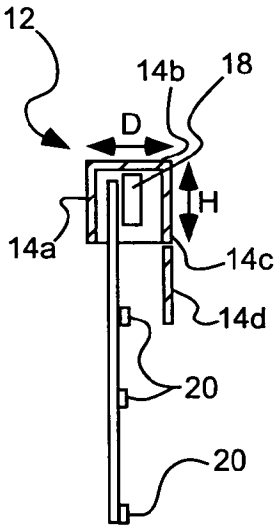
FIG. 2 is an end view of the system of FIG. 1.

Before the present invention is disclosed and described, it should be understood that this invention is not limited to the particular structures, process steps, or materials disclosed herein, but is extended to equivalents thereof as would be recognized by those of ordinarily skill in the relevant arts. It should also be understood that terminology employed herein is used for the purpose of describing particular embodiments only and is not intended to be limiting in any way.

It must be noted that, as used in this specification and the appended claims, the singular forms "a" and "the" include plural referents, unless the context clearly dictates otherwise. Thus, for example, reference to an "enclosure panel" can, but does not necessarily, include one or more of such enclosure panels.

Definitions

In describing and claiming the present invention, the following terminology will be used in accordance with the definitions set forth below.

As used herein, the term "lighting element pattern" is to be understood to refer to a pattern formed by a plurality of lighting elements, the pattern being defined by relative spacing of the lighting elements one from another. Generally, the pattern formed by the lighting elements will not be dependent upon an angle in which the pattern is viewed. In other words, two or more lighting elements that are spaced specific distances from one another define a lighting pattern, regardless of how the lighting elements may be collectively rotated, turned or moved in space (so long as the relative spacing between the lighting elements does not change). In order for two lighting element patterns to be distinct (or different) from another, the spacing between the lighting elements must be changed in some manner. Merely collectively rotating, turning or moving the lighting elements will not change the lighting element pattern.

As used herein, directionally relative terms such as upwardly, downwardly, laterally, etc., are sometimes used to refer to components of lighting systems and structural units or bases (e.g., houses, buildings, posts, overpasses, etc.) to which the lighting systems can be attached. It is to be understood that such terms are offered only to most clearly describe and claim the present invention and do not necessarily limit the scope of the invention.

As used herein, the term "substantially" refers to the complete or nearly complete extent or degree of an action, characteristic, property, state, structure, item, or result. For example, when two or more objects are referred to as being spaced a "substantially" constant distance from one another, it is understood that the two or more objects are spaced a completely unchanging distance from one another, or so nearly an unchanging distance from one another that a typical person would be unable to appreciate the difference. The exact allowable degree of deviation from absolute completeness may in some cases depend upon the specific context. However, generally speaking the nearness of completion will be so as to have the same overall result as if absolute and total completion were obtained.

The use of "substantially" is equally applicable when used in a negative connotation to refer to the complete or near complete lack of an action, characteristic, property, state, structure, item, or result. For example, a cavity that is "substantially free of" foreign matter would either completely lack any foreign matter, or so nearly completely lack foreign matter that the effect would be the same as if it completely lacked foreign matter. In other words, a cavity that is "substantially free of" foreign matter may still actually contain minute portions of foreign matter so long as there is no measurable effect upon the cavity as a result thereof.

When lighting elements or light-bearing members are discussed herein as being "retracted into a housing" or "extended from a housing," it is to be understood that the lighting element or light-bearing member need not be completely within all confines of the housing, or completely out of all confines of the housing, to qualify as "retracted" or "extended," respectively. For example, a majority of a light-bearing member may be disposed out of a housing and said light-bearing member could be considered extended from the housing, even though a portion of the light-bearing member may still reside within the confines of the housing. Similarly, most of a light-bearing member may be disposed within the confines of a housing (with a small portion remaining exposed beyond the confines of the housing) and the light-bearing member could still be considered "retracted" into the housing.

Also, light-bearing members are, at times, shown and discussed herein as being in a "display configuration." It is to be understood that a light-bearing member may be extended or retracted into a variety of positions that can all constitute a "display configuration." For example, a light-bearing member may have a maximum extension to which the member can be extended and maintained. However, the light-bearing member may have occupied a plethora of "display configurations" during extension of the light-bearing member (prior to reaching the maximum extension).

Furthermore, when a lighting element or light-bearing member (or other component of the systems described and shown herein) is discussed as being "retracted into" or "stored within" a housing, it is to be understood that the element or member being discussed may not be completely circumscribed by the housing to constitute being stored within the housing. For example, a housing may be shaped as a channel that is partially or fully open on one or more sides, yet an element or member may still be "stored" within the general confines of the housing. Thus, the housings of the present invention need not form complete enclosures but will generally serve to protect and conceal the components of the lighting system with two or more enclosure panels. In some embodiments, however, the housings of the present invention will be capable of completely enclosing the lighting system, for example by being provided with closeable doors or panels that can close after the components of the lighting system have been retracted into the housing.

As used herein, the term "about" is used to provide flexibility to a numerical range endpoint by providing that a given value may be "a little above" or "a little below" the endpoint.

Distances, angles, forces, weights, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited.

As an illustration, a numerical range of "about 1 inch to about 5 inches" should be interpreted to include not only the explicitly recited values of about 1 inch to about 5 inches, but also include individual values and sub-ranges within the indicated range. This same principle applies to ranges reciting only one numerical value and should apply regardless of the breadth of the range or the characteristics being described.

The Invention

The present invention is directed to lighting systems for providing informational or decorative lighting displays. In one aspect of the invention, systems in accordance with the present invention can be used to provide decorative or festive lighting to a home or residence. The invention can provide a decorative lighting system that can be substantially permanently installed on a home or dwelling and maintained in position throughout the year. Due to various advantages of the present invention, the operable components of the system can be protected and/or concealed within a housing, and selectively extended for use when desired. When a user no longer desires to display the lights, he or she can simply and easily retract the lights into the protective/concealing housing. The present invention thus provides a lighting system that can be used at selected times throughout the year, without requiring that a user hang, then uninstall, strings of light to create a lighting display.

As shown generally in FIGS. 1, 1A, 2 and 2A, in accordance with one embodiment of the invention, a lighting system 10 is provided that can be used for ornamental, decorative or informational lighting displays. The system can include a housing 12 that can be suitable for mounting to a structural unit (not shown), such as a dwelling, place of business, bridge or overpass, etc. The housing can include a plurality of enclosure panels 14*a*, 14*b*, 14*c*, 14*d* (note that frontal panel 14*a* is shown removed in FIGS. 1 and 1A; and that panel 14*d* is shown in an open configuration in FIG. 2 and in a closed configuration in FIG. 2A). The enclosure panels can collectively form the housing, which can, depending upon the embodiment, be configured as a fully enclosable housing, or a partially enclosable housing (e.g., the housing may only include 3 panels, with a lowermost section being substantially open to the surrounding environment).

At least one light-bearing member 16 can be moveable relative to each of the enclosure panels (e.g., the light-bearing member can move independently of any movement the enclosure panels may be capable of). An actuator 18 can be in operable communication with the at least one light-bearing member. The actuator can be operable to selectively: extend the light-bearing member from the housing into a display configuration (as shown by example in FIG. 1); and/or retract the light-bearing member into the housing (as shown by example in FIG. 2). In some embodiments, the actuator 18 need be capable only of retracting the light-bearing member into the housing: as gravity may be the only force required to extend the light-bearing members into the housing.

At least one lighting element 20 can be carried by the light-bearing member 16. The at least one lighting element can be visible by a spectator when the light-bearing member is at least partially extended from the housing 12. As will be appreciated by viewing FIGS. 1-2A, the actuators 18 can be suitable to selectively extend the light-bearing members from the confines of the housing so that a spectator can view the lighting elements. When desired, the actuators can retract the light bearing members into the housing (at which point control circuitry can discontinue power to the lighting elements to extinguish the lights), where the light-bearing members and the lighting elements can be protected from exposure to wind, water, snow, ice, etc., and/or can be concealed from view for aesthetic or architectural purposes.

The housing 12 shown can include enclosure panel 14*d* that can be moveable relative to housing, to open and close as needed to allow the light-bearing members 16 to extend from the housing. While not so required, in the embodiment shown the housing 12 includes a generally elongate configuration, with a width "W" of the housing being generally much greater than a height "H" or a depth "D" of the housing. In this aspect of the invention, the light-bearing members can include a length "L" that is greater than either the width depth "D" of the housing or the height "H" of the housing. In this manner, the light display provided by the system can occupy a much greater space than conventional systems and provide a much more pleasing array of lights.

Figure 2A:
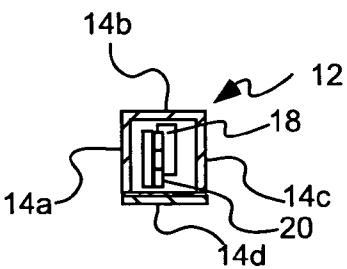
FIG. 2A is an end view of the system of FIG. 2 (with a lower enclosure panel 14*d* shown in a closed position)
Figure 1:
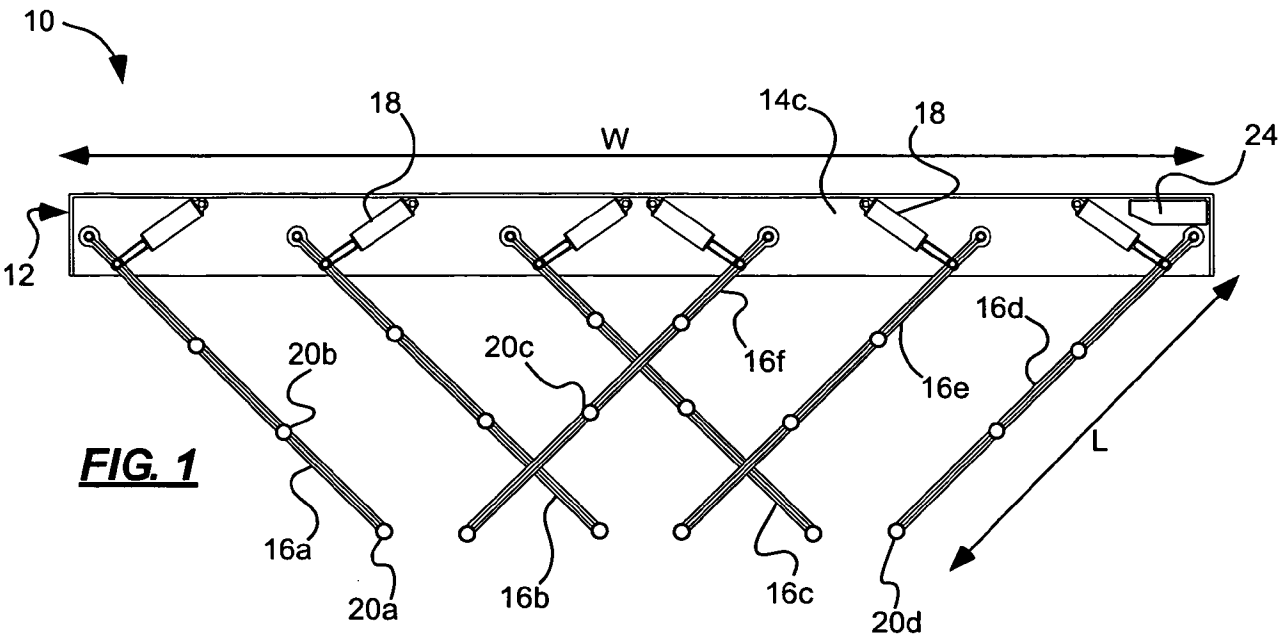
FIG. 1 is front view of a lighting system in accordance with an embodiment of the invention (with a frontal enclosure panel 14*a* shown removed from the housing)

In the embodiment illustrated in FIGS. 1-2A, the light-bearing members 16 are storable within the housing in a substantially parallel relationship to a longitudinal axis of the housing, and can be extendable into a display configuration so as to be oriented at a non-parallel angle to the longitudinal axis of the housing. In this manner, the storage space of the housing can be most efficiently utilized to provide good protection and/or concealment of the light-bearing members (and lighting elements 20) while providing a great deal of display spacing between individual lighting elements when the light-bearing members are extended from the housing.

In the embodiment shown in FIGS. 1-2A, the actuators 18 can include electrically activated solenoids, motors, or similar devices known to those having ordinary skill in the art, that can be individually or collectively activated by a control system (shown schematically at 24). For example, the control system may actuate the actuators associated with light-bearing members 16*a*-16*c* in a coordinated manner, causing each of these actuators to move at the same time and at the same rate. The actuators associated with light-bearing members 16*d*-*f* could similarly be coordinated. Thus, the control system can provide animation to the light display, creating a much more varied and visually pleasing presentation than is possible with conventional systems. Similarly, each of the solenoids or actuators can be individually actuated, resulting in an animated display that provides a user with a great deal of flexibility.

Figure 3A:
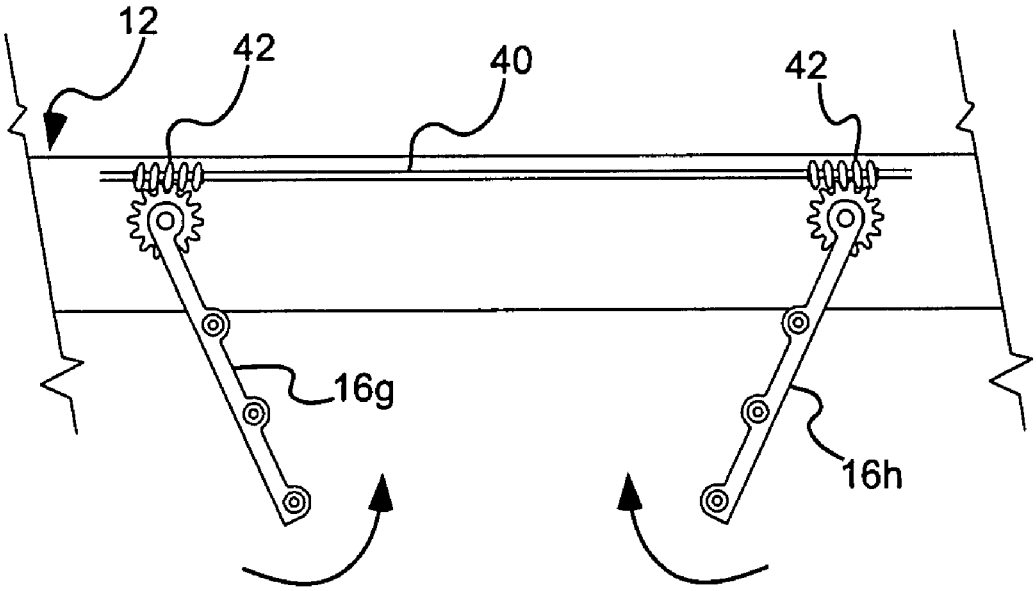
FIG. 3A is a front view of a portion of a light housing in accordance with an embodiment of the invention, with the light bearing members shown configured to rotate in opposite directions.
Figure 3B:
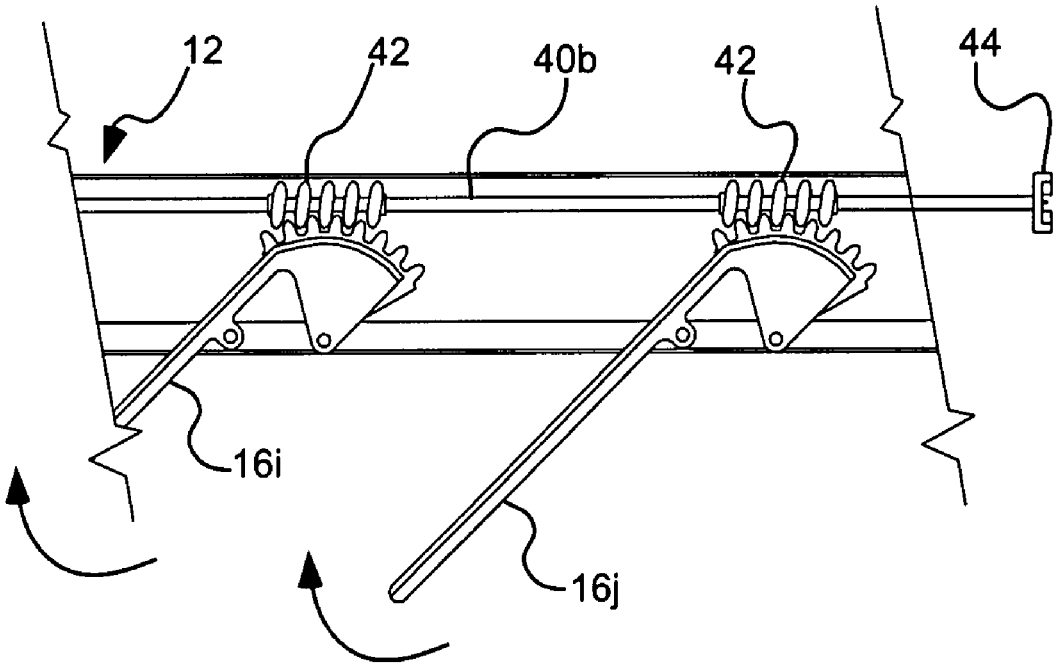
FIG. 3B is a front view of a portion of a light housing in accordance with an embodiment of the invention, with the light bearing members shown configured to rotate in the same direction.

In addition to the individual motors, actuators, solenoids, etc., shown in FIGS. 1-2A, the system can include one or more centralized motors or actuators that can be coupled to two or more of the light-bearing members. As shown in FIGS. 3A and 3B, in one aspect of the invention, a central shaft 40 can be provided that can be powered by an actuator (not shown in this view) to provide rotational movement to the shaft. A worm-gear assembly 42 can be associated with light-bearing members 16*g*, 16*h*. As the shaft 40 rotates, the worm gear assembly can cause the light-bearing members to move into or out of the housing. In the embodiment shown in FIG. 3A, rotation of the central shaft causes the light-bearing members to move at opposite rotational directions. In the embodiment illustrated in FIG. 3B, rotation of shaft 40*b* causes the light-bearing members 16*i*, 16*j* to move in the same rotational direction.

FIG. 3B also illustrates connector 44 that can be connected or associated with an actuator or motor to power the shaft 40*b*. One skilled in the relevant art, having possession of this disclosure, could readily understand the workings of such a system. The connector 44 can also be used to connect two or more of the housings 12 in series with one another, so that movement of one actuator can result in movement of each of a plurality of light-bearing members, even in the case where the light-bearing members are a part of system (e.g., are disposed within another housing) incorporated into an adjacent or distally located housing.

In addition to the solenoids, motors, etc., that can be used for the actuator, it is also contemplated that a manual actuator can be utilized. For example, the system can be readily adapted to utilize a hand crank or pull string/lever to retract and/or extend the light-bearing elements.

Figure 4A:
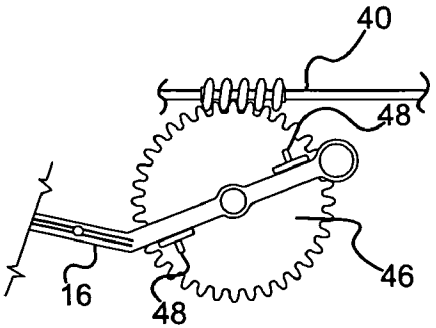
FIG. 4A is a partial view of a light system in accordance with an embodiment of the invention, with a gear rotated so as to allow a light-bearing member to swing freely.
Figure 4B:
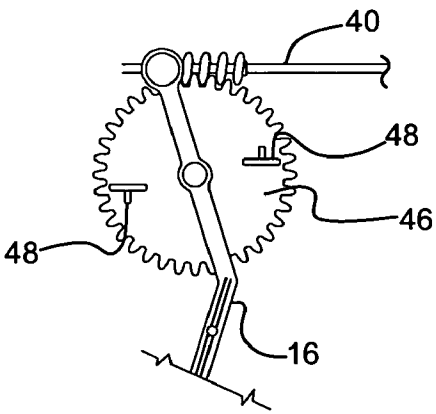
FIG. 4B is another view of the system of FIG. 4A, with the gear shown rotated so as to engage the light-bearing member.
Figure 6A:
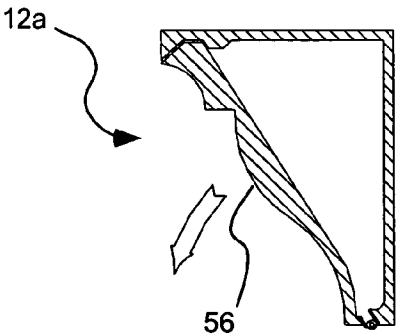
FIGS. 6A through 6D are a series of figures illustrating operation of a housing including a decorative panel in accordance with an embodiment of the invention.
Figure 6B:
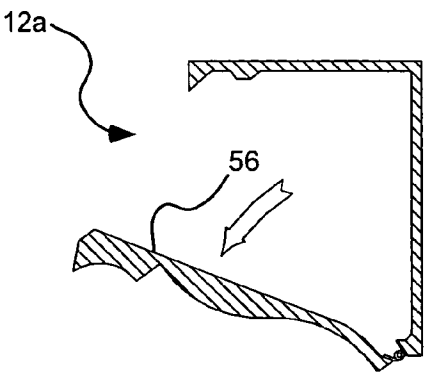
Figure 6C:
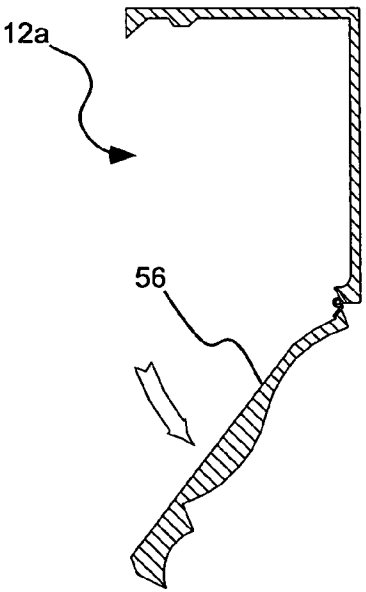
Figure 6D:
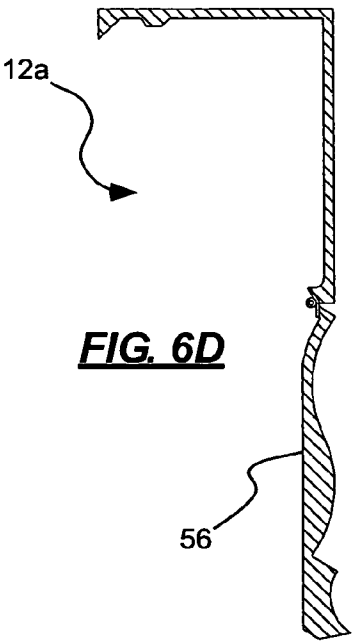

FIGS. 4A and 4B illustrate an aspect of the invention in which a light-bearing member is pivotally related to gear 46 that includes a pair of stops 48 that are positioned so as to engage the light-bearing member during only a portion of the rotational travel of the gear. This embodiment can be advantageous in applications in which it is desired, for one reason or another, to allow the light-bearing member to swing freely when in an extended, or display, configuration. As shown in FIG. 4A, when the gear is rotated to position the light-bearing member in a display orientation, the stops are spaced from the light-bearing member allowing the light-bearing member to swing freely in a limited amount of travel. When it is desired to retract the light-bearing member into the housing, gear 46 can rotate until stops 48 engage the light-bearing member and begin rotating it upwardly. This aspect of the invention has been found to perform well in applications in which the housing is installed at an angle from horizontal (e.g., along a slanted roofline), to allow the light-bearing members to swing freely downward in a substantially vertical display orientation, even when the housing is not level.

Figure 5:
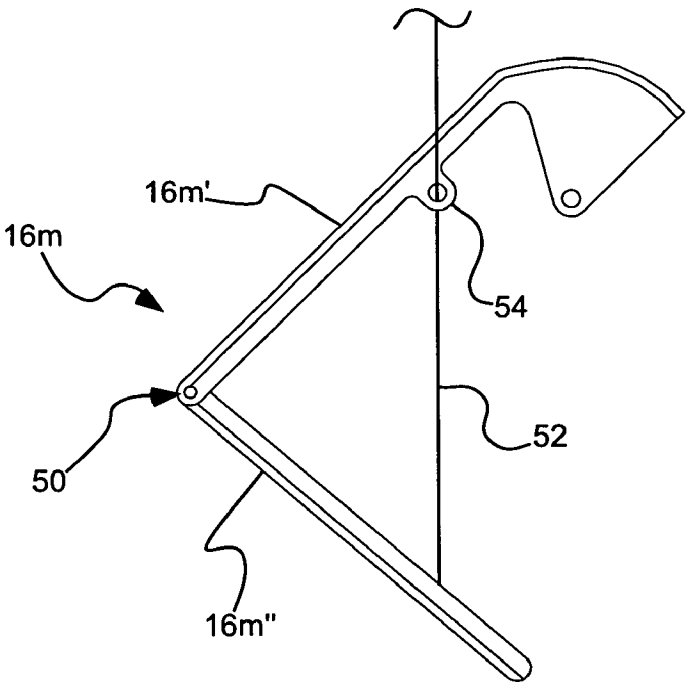
FIG. 5 is a front view of a segmented, articulated light-bearing member in accordance with an embodiment of the invention.

As shown in FIG. 5, in one aspect of the invention, a light-bearing member 16*m* can be provided that includes at least two substantially rigid segments 16*m*', 16*m*" that can be oriented in a non-parallel relationship to one another. While not so required, the segments can be moveably articulated at a joint 50 at which the segments are coupled to one another. In this manner, an overall display length of the light-bearing member can be leveraged while utilizing a relatively smaller storage space inside the housing (not shown in this view). In other words, the distance beyond which the light-bearing member can extend from the depth or height of the housing can be maintained while halving the storage distance required along the width of the housing.

One manner in which the light-bearing member can be retracted into the housing is by way of cord or tether 52 that can be incorporated into a spooling device (not shown) within the housing. The cord or tether can extend through an opening 54 in segment 16*m*' and can be coupled to segment 16*m*". As the cord is extended from the housing, segments 16*m*' and 16*m*" unfold from one another into an extended configuration. As the cord is retracted toward the housing, the segments fold into one another and are retracted into the housing.

In addition to including a segmented configuration, the light-bearing members of the present invention can include a decorative shape, to enhance the visual display of the system. Examples of decorative shapes include, without limitation, reindeer legs, skeleton legs, manikin arms or legs, candy canes, candles, stars, sled runners, etc. The decorative shapes of the light-bearing members can be particularly advantageous in systems that provide animation to the light-bearing members. In such systems, the "legs" or "arms" can be made to wave or dance to provide an active display unlike conventional displays. It is also contemplated that one or more of the light-bearing members may not bear lighting elements, but may instead be presented to add animation to a display. Thus, for example, in a Christmas display, one or more of the light-bearing members may be moved about and include lighting elements, while one or more may be moved about without contributing lighting affects, but only movement affects. Also, the light-bearing members may include the same decorative shape, or they can include differing decorative shapes.

One or more light-bearing members can include a plurality of sets of lighting elements that each include a different color, or form a different pattern, and can be selectively powered or controlled by the control system at differing times. As a non-limiting example, the light bearing member 16*n* shown in FIG. 8A can include lighting elements 20 that form a pattern of a snowman (as shown), and can also include other lighting elements (not shown) that form a pattern of a flag. The control system can be programmed or controlled such that, during Christmastime, for example, only the lighting elements that form the snowman are powered. During Jul. $4^{th}$ celebrations, the lighting elements (not shown) that form the flag can be powered. It is has been found that, when not illuminated, the snowman-forming lighting elements will not be easily seen and will not interfere or detract from the flag pattern formed by the remaining lighting elements.

The control system 24 can be of a variety of types understood by those of ordinary skill in the art, and can be programmed or controlled locally or remotely. The control system can be in communication, for example, with a home computer to allow a user to program the system. The control system can include a remote control, to allow a user to remotely control the lighting patterns, light-bearing element motions, add musical effects, etc.

Figure 1A:
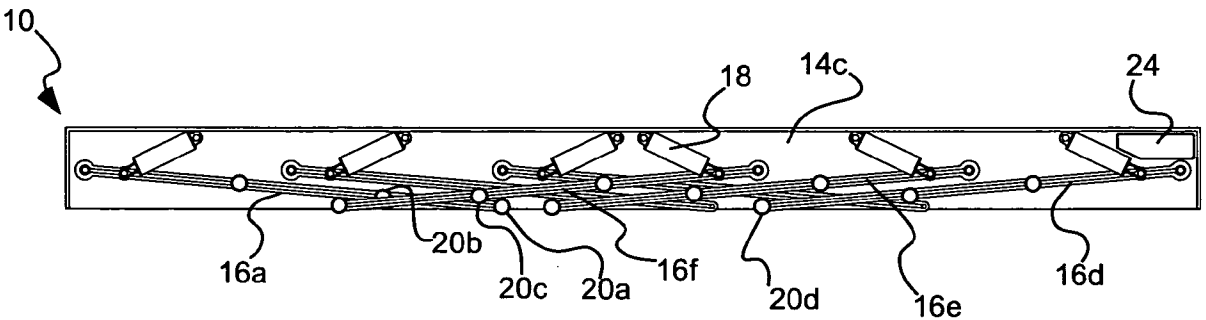
FIG. 1A is a front view of the system of FIG. 1, with a plurality of light-bearing members shown in a retracted condition.

Returning now to FIG. 1, in one aspect of the invention, a plurality of lighting elements 20*a*, 20*b*, 20*c*, 20*d*, etc., can be carried by a plurality of light-bearing members. In this embodiment, extension of the plurality of light-bearing members can result in changing relative spacing of at least some of the plurality of lighting elements from one another in both a vertical and a horizontal aspect. In other words, when the light-bearing members are in the storage or retracted configuration in the housing (as shown in FIG. 1A), the lighting elements are spaced from one another in a particular pattern. As the light-bearing members are extended from the housing (as shown in FIG. 1), the lighting elements assume a different spaced relationship from one another. While not so required, generally the lighting elements will be spaced further apart, both vertically and horizontally, from one another when in the extended position than when in the retracted (or stored) position. Thus, the present invention allows a more visually appealing, spatially disparate arrangement of lighting elements than conventional lighting systems, while also providing for storage or concealment of the lighting elements when desired.

FIGS. 6A through 6D illustrate an aspect of the invention in which a decorative panel 56 is attachable over or to (or formed integrally with) at least one of the enclosure panels to provide a decorative feature to the housing 12*a*. In this aspect of the invention, the decorative panel is formed to replicate exterior crown molding often applied to residential and commercial dwellings. The decorative feature can add to the unique manner in which the present invention can be integrated with an existing dwelling to conceal the decorative lighting assembly until it is desired to activate the lighting elements. When it is desired to active the lighting elements, the decorative housing panel 56 can be extended downward to allow light-bearing members (not shown in these figures) to be extended from the housing.

Figure 7A:
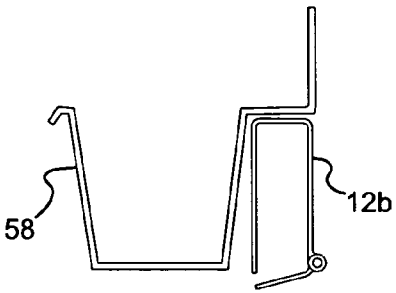
FIGS. 7A through 7C illustrate various housings incorporated with rain gutter systems in accordance with embodiments of the invention.
Figure 7B:
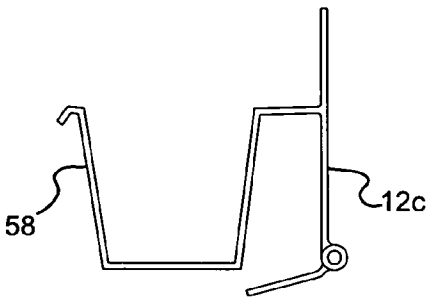
Figure 7C:
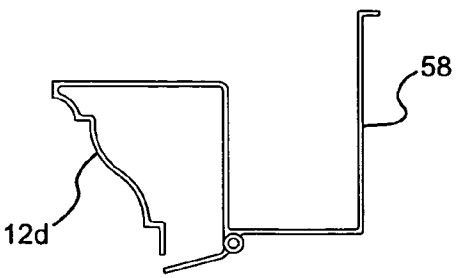

FIGS. 7A through 7C illustrate alternate housing configurations 12*b* through 12*d* that can be incorporated into various raingutter structure 58 to further integrate the present system within the ordinary appearance of the dwelling. It will be appreciated that the present system can be adapted into a variety of configurations to both allow safe storage of the lighting elements when the lighting system is not in use, and to conceal the appearance or presence of the lighting system when not in use.

Figure 8B:
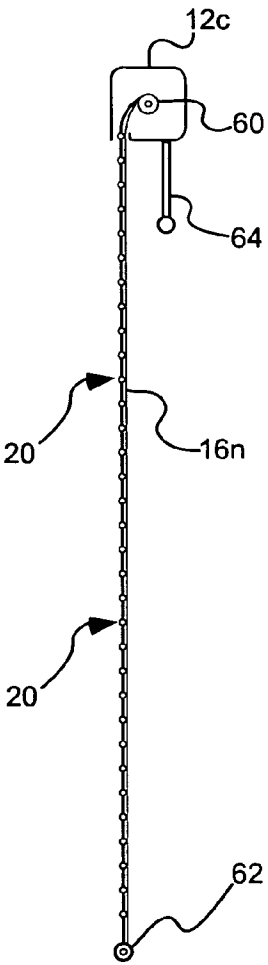
FIG. 8B is a side view of the system of FIG. 8A.
Figure 8A:
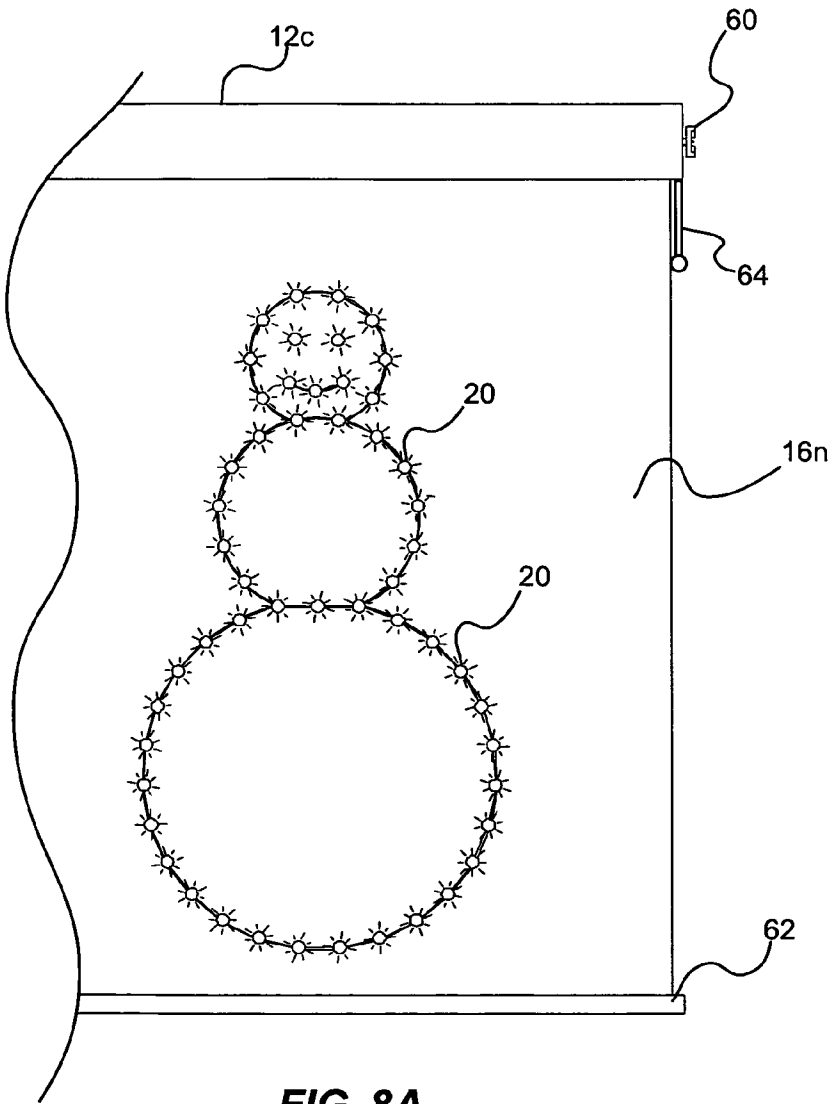
FIG. 8A is a partial, front view of another lighting system in accordance with an embodiment of the invention.

FIGS. 8A and 8B illustrate an embodiment of the invention in which the light-bearing member 16*n* includes a relatively flexible sheet onto which (or into or through which) lighting elements 20 can be incorporated. In this aspect of the invention, an actuator (not shown in detail) can be operably coupled to a roller 60 onto which the light-bearing can be rolled. When it is desired to extend the light-bearing member from the housing 12*e*, the actuator can unroll the light-bearing member and allow it to extend downwardly from the housing. A weight 62 can aid in unrolling the light-bearing member, and in maintaining the position of the light-bearing member once unrolled. The weight can be sized and shaped to serve as a "door" to the enclosure 12 to substantially seal the enclosure when the light-bearing member is rolled up.

FIGS. 8A and 8B also illustrate the use in the present system of one or more sensors 64 that can be advantageously used to automatically retract the light-bearing members of the present system in the case adverse weather conditions arise. For example, sensor 64 may be a wind speed sensor that can detect unsafe or undesirable wind conditions, and cause the control system to retract the light-bearing member or members into the housing. This aspect of the invention can aid in preventing damage being done to the system due to high or turbulent winds, heavy rain- or snow-fall, etc.

Figure 9A:
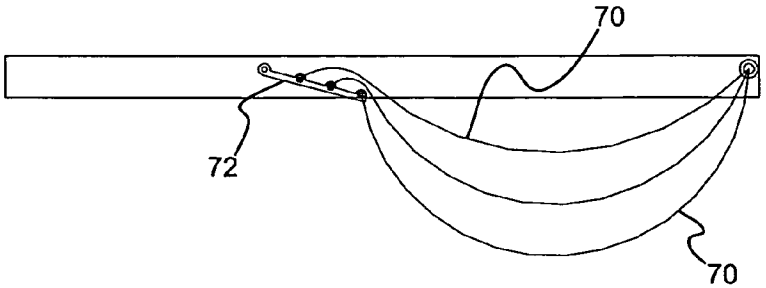
FIG. 9A is a front view of another lighting system in accordance with an embodiment of the invention.
Figure 9B:
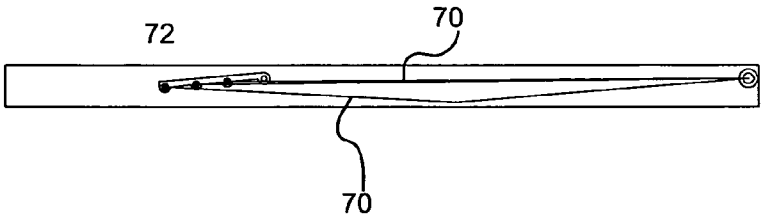
FIG. 9B is a front view of the system of FIG. 9A, shown in a retracted or closed configuration.
Figure 10A:
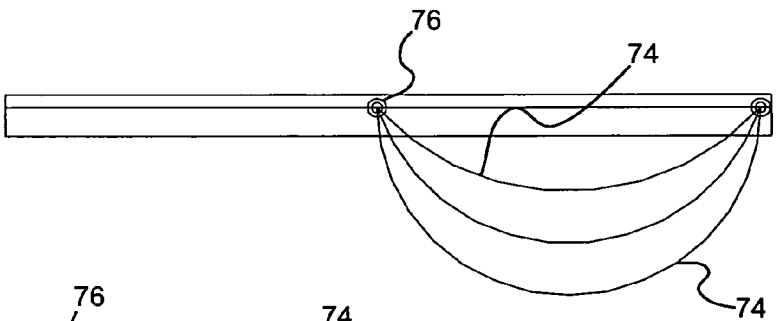
FIG. 10A is a front view of another lighting system in accordance with an embodiment of the invention.
Figure 10B:
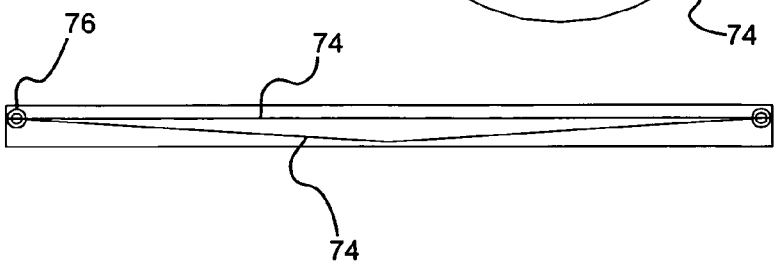
FIG. 10B is a front view of the system of FIG. 10A, shown in a retracted or closed configuration.

FIGS. 9A and 9B illustrate an embodiment of the invention in which the light-bearing member can include a series of flexible cords 70 on which lighting elements (not shown) can be attached (or with which lighting elements can be incorporated). This system includes a pivot arm 72 to which the light-bearing members are attached. As the arm pivots to the right of the figure, the light-bearing members "sag" or suspend downward to extend the lighting elements from the housing. As the pivot arm rotates to the left of the figure, the light-bearing member is stretched taught and retracts the lighting elements into the housing. FIGS. 10A and 10B illustrate a similar configuration, except that the light-bearing members 74 are coupled to a slider 76. As the slider moves left or right, the light-bearing members sag downward or become taught (depending upon the direction of travel of the slider).

Figure 11A:
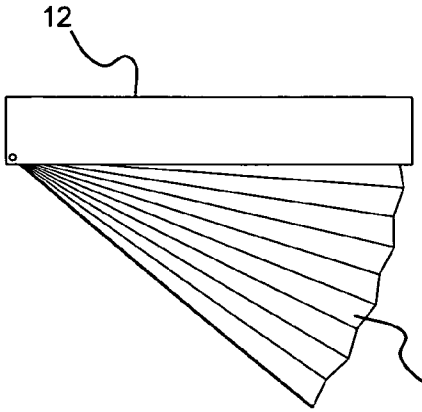
FIG. 11A is a front view of another lighting system in accordance with an embodiment of the invention, shown in a partially extended configuration.
Figure 11B:
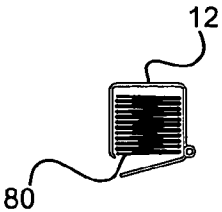
FIG. 11B is a side view of the system of FIG. 11A.
Figure 11C:
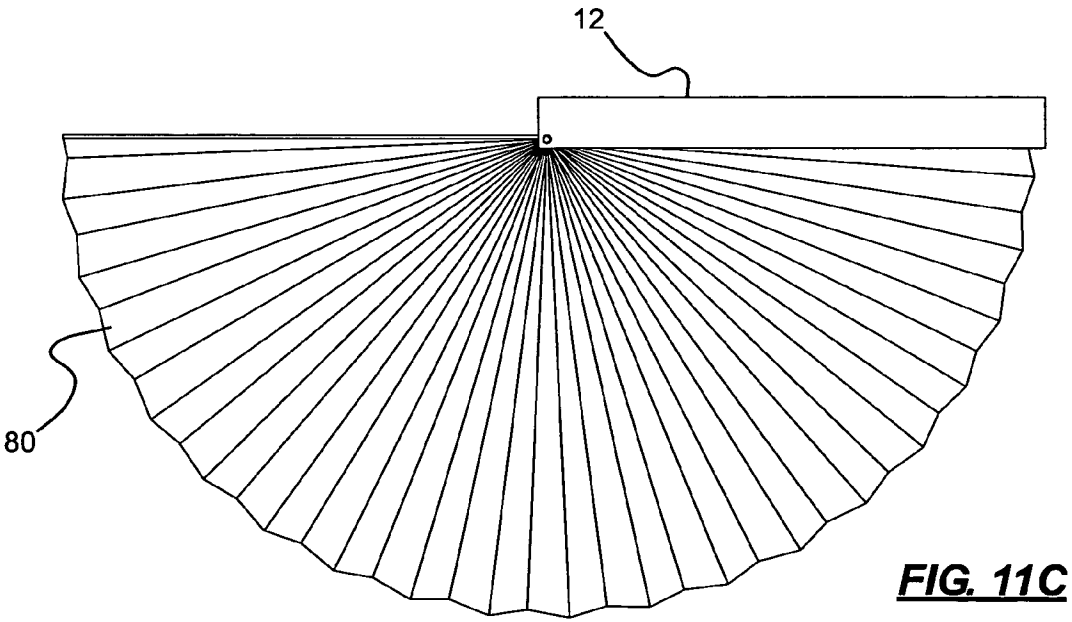
FIG. 11C is a front view of the system of FIG. 11A, shown in a substantially fully extended configuration.

FIGS. 11A through 11C illustrate another embodiment of the invention, with the light-bearing member 80 including, in this case, a foldable member that can retract into the housing by folding (in "accordion" style) into a compact, storable arrangement (as shown in FIG. 11B). FIG. 11C illustrates the light-bearing member in a substantially fully extended configuration. This embodiment of the invention can be particularly advantageous in applications where an odd-shaped space is being filled with a lighting display (e.g., a space between two angled rooflines, a half-circular window, etc.). Similar to the use of the weight 62 in the embodiment shown in FIGS. 8A and 8B, the lowermost portion of the light-bearing member 80 of FIGS. 11A-11C can be sized and shaped to serve as a bottom "door" of the enclosure 12 to substantially close or seal the enclosure when the light-bearing member is fully retracted into the housing. This aspect of the invention can be incorporated into a variety of different embodiments of the invention.

The present system can be powered in a number of manners (the control system 24 will likely require a power source). In one aspect of the invention, the power supply can be a conventional 120 volt connection. Other aspects of the invention can utilize a battery power source, solar power source, etc. Due to the many outdoor applications of the present invention, a solar power source has been found to be particularly efficacious.

The lighting elements 20 utilized with the present invention can take a variety of forms, including, without limitation, conventional incandescent bulbs, LED lights, fluorescent lights, etc. Due to the lightweight and flexible applications the present invention is suited for, the use of LED lights has been found to be particularly satisfactory.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A lighting system, comprising:

a housing, suitable for mounting to a structural unit, the housing including a plurality of enclosure panels;

a plurality of light-bearing members, each moveable relative to the enclosure panels;

an actuator, in operable communication with at least one of the light-bearing members, the actuator being operable to selectively extend the light-bearing member from the housing into a display configuration; and retract the light-bearing member into the housing; and at least one lighting element attached along a length of each of the light-bearing members, each of the lighting elements being visible by a spectator when a respective light-bearing member is at least partially extended from the housing; wherein at least one of the light-bearing members includes at least two substantially rigid segments oriented in a non-parallel relationship to one another, each of the rigid segments having at least one lighting element attached along a length thereof.

2. The system of claim 1, wherein the light-bearing members are each storable within the housing in a substantially parallel relationship to a longitudinal axis of the housing, and are each extendable into a display configuration so as to be oriented at a non-parallel angle to the longitudinal axis of the housing.

3. The system of claim 1, wherein the housing includes a longitudinal dimension, a height dimension and a depth dimension, and wherein the light-bearing members are sized such that: when the light-bearing member is in the display configuration the at least one lighting element is displaced from the housing a distance greater than a largest of: the depth dimension of the housing and the height dimension of the housing.

4. The system of claim 1, further comprising a motor, operably attached to the actuator, and wherein activation of the motor results in movement of the actuator.

5. The system of claim 4, further comprising a control system in communication with the motor, the control system capable of providing a signal to the motor resulting in movement of the actuator.

6. The system of claim 5, wherein movement of the actuator results in animation of the light-bearing members.

7. The system of claim 1, wherein the light-bearing members are extendable beyond all enclosure panels of the housing.

8. The system of claim 1, wherein extension of the plurality of light-bearing members results in changing relative spacing of at least some of the plurality of lighting elements from one another in both a vertical and a horizontal aspect.

9. The system of claim 1, wherein the rigid segments are moveably articulated at a joint at which the segments are coupled to one another.

10. The system of claim 1, wherein the lighting elements are restrained to a substantially common plane when extended into the display configuration and when retracted into the housing.

11. The system of claim 1, wherein the lighting elements are coupled along a length of the light-bearing members distal from ends of the light-bearing members.

12. The system of claim 1, wherein the lighting elements are fixed relative to the light-bearing members.

13. The system of claim 1, wherein the lighting elements are oriented to project light perpendicularly to a plane in which the light-bearing members extend.

14. The system of claim 1, wherein the lighting elements are attached directly to the light-bearing members along the lengths of the light-bearing members.

15. A lighting system, comprising:

a housing, suitable for mounting to a structural unit, the housing including a longitudinal dimension, a height dimension and a depth dimension;

a plurality of light-bearing members, moveable relative to the housing and extendable into a display configuration, the light-bearing members each having at least one lighting element attached along a length thereof;

an actuator, in operable communication with the light-bearing members, the actuator being operable to selectively retract the light-bearing members into the housing after the light-bearing members have has been extended from the housing into a display configuration;

the light-bearing members each being sized such that: when the light-bearing members are in the display configuration the at least one lighting element is displaced from the housing a distance greater than a largest of: the depth dimension of the housing and the height dimension of the housing; wherein at least one of the light-bearing members includes at least two substantially rigid segments oriented in a non-parallel relationship to one another, each of the rigid segments having at least one lighting element attached along a length thereof.

16. The system of claim 15, wherein the light-bearing members are storable within the housing in a substantially parallel relationship to a longitudinal axis of the housing, and are extendable into a display configuration so as to be oriented at a non-parallel angle to the longitudinal axis of the housing.

17. The system of claim 15, further comprising a motor, operably attached to the actuator, and wherein activation of the motor results in movement of the actuator.

18. The system of claim 17, further comprising a control system in communication with the motor, the control system capable of providing a signal to the motor resulting in movement of the actuator.

19. The system of claim 18, wherein movement of the actuator results in animation of the light-bearing member.

20. The system of claim 15, wherein extension of the plurality of light-bearing members results in changing relative spacing of at least some of the plurality of lighting elements from one another in both a vertical and a horizontal aspect.

21. The system of claim 15, wherein the rigid segments are moveably articulated at a joint at which the segments are coupled to one another.

22. The system of claim 15, further comprising a decorative panel, attachable over or to at least one of the enclosure panels to provide a decorative feature to the housing.

23. The system of claim 15, wherein the lighting elements are restrained to a substantially common plane when extended into the display configuration and when retracted into the housing.

* * * * *